US005427126A

United States Patent [19]

Carney et al.

[11] Patent Number: 5,427,126

[45] Date of Patent: Jun. 27, 1995

[54] SATELLITE EDUCTOR CLEAN-IN-PLACE SYSTEM

[75] Inventors: Michael Carney, Kenosha; Richard Kramer, Racine, both of Wis.

[73] Assignee: Tri-Clover, Inc., Kenosha, Wis.

[21] Appl. No.: 136,772

[22] Filed: Oct. 14, 1993

[51] Int. Cl.[6] ..... B08B 9/00

[52] U.S. Cl. ..... 134/98.1; 134/95.3; 134/103.1; 134/104.1; 134/105; 134/169 R; 134/169 C; 134/99.2

[58] Field of Search ..... 134/98.1, 95.1, 103.1, 134/104.1, 104.2, 95.3, 99.2, 169 C, 169 R, 95.2, 105; 15/302

[56] References Cited

U.S. PATENT DOCUMENTS

| | | | |
|---|---|---|---|
| 2,558,628 | 6/1951 | Redin | 134/98.1 X |
| 3,140,828 | 7/1964 | Galanor | 134/103.1 X |
| 3,435,834 | 4/1969 | Cooper | 134/98.1 |
| 3,448,745 | 6/1969 | Seeley . | |
| 3,719,191 | 3/1973 | Zimmerly . | |
| 4,061,504 | 12/1977 | Zall et al. | 134/98.1 |
| 4,191,348 | 3/1980 | Holwerda | 134/103.1 |
| 4,217,924 | 8/1980 | Finger . | |
| 4,616,377 | 10/1986 | Urbani . | |
| 4,619,015 | 10/1986 | Urbania . | |
| 4,696,073 | 9/1987 | Urbani . | |
| 4,707,878 | 11/1987 | Urbani . | |
| 5,348,058 | 9/1994 | Ruhl | 134/169 C |

*Primary Examiner*—Frankie L. Stinson
*Attorney, Agent, or Firm*—Ryan, Kees & Hohenfeldt

[57] ABSTRACT

A cleaning system for cleaning a plurality of service tanks located at different sites spaced widely apart from each other. A set of storage tanks is located at one site, for storing cleaning solutions, each cleaning solution being recirculated through a respective recirculating line from each storage tank. The cleaning system further includes cleaning stations, one for each service tank assembly, each located close to its respective service tank assembly, each cleaning station having a connection to each recirculating line. Each cleaning station includes a wash/motive tank for a washing liquid, a rinse tank for a rinsing liquid, and an outlet line leading from each of the wash/motive tank and the rinse tank. Liquid is conveyed from the outlet lines of the wash-/motive tank and rinse tank to the respective service tank assembly via a feed line. A return line is adapted to return liquid from the respective service tank assembly. An eductor has a vacuum opening connected to the return line. A motive pump delivers liquid from the outlet line of the wash/motive tank through the eductor to create a vacuum in the return line and draw liquid from the service tank assembly. Also included is a method of cleaning the service tank assemblies by use of the cleaning stations.

8 Claims, 2 Drawing Sheets

SATELLITE EDUCTOR CLEAN-IN-PLACE SYSTEM

BACKGROUND OF THE INVENTION

This invention relates to clean-in-place systems, that is, systems for cleaning sanitary distribution systems without disassembly, and in particular to such cleaning systems that to not require separate full-sized storage tanks for each tank to be cleaned.

Conventional clean-in-place systems use a complete set of large cleaning solution storage tanks for each service tank to be cleaned. This system requires a large capital investment and is inefficient, not only because it entails the storage of large amounts of cleaning solutions for each service tank to be cleaned, but also because it takes up large amounts of floor space to have multiple sets of these large storage tanks in various different parts of the plant.

One solution to the space problem is posed by Zimmerly, U.S. Pat. No. 3,719,191, wherein the motive tank is positioned within the rinse tank. This design, however, does not address the inefficiency of storing large amounts of cleaning solution at a number of different locations, and still requires a large capital investment.

A solution to the latter problem has been to employ portable cleaning systems, which require reduced capital investments, and are particularly beneficial for use with new product and/or process developments. Once a process or product is established, though, the limits of the portable units become apparent. Portable units are generally smaller in size and require manual connections of all utilities at each user location. This requirement of disconnection and re-connection of utilities reduces the convenience of the portable units. Further, the capacities of the portable units may come into question in relation to the service tank and associated system to be cleaned. Often the equipment being cleaned requires greater volumes or higher flow rates than the portable unit can supply.

This invention relates to improvements over the apparatus set forth above and to solutions to the problems raised or not solved thereby.

SUMMARY OF THE INVENTION

The invention includes a cleaning system for cleaning a plurality of service tank assemblies located at different sites spaced widely apart from each other. For purposes of this description, each service tank assembly includes the service tank itself, and associated control valves and hydraulic circuitry. According to the invention, the cleaning system includes a single set of storage tanks, located substantially at one site, for storing various cleaning solutions. Each tank has its own respective recirculating line, through which its respective solution is continuously recirculated. The cleaning system further includes a plurality of cleaning stations, one for each service tank assembly, each cleaning station located relatively close to its respective service tank assembly, each cleaning station having a connection to each recirculating line. Each cleaning station includes a wash/motive tank for a washing liquid, a rinse tank for a rinsing liquid, and an outlet line leading from each of the wash/motive tank and the rinse tank. A feed line, having a supply pump in the line, is provided for conveying liquid from either the rinse tank or the wash/motive tank to the respective service tank assembly. A return line is adapted to return liquid from the respective service tank assembly. An eductor has a vacuum opening connected to the return line. A motive pump delivers liquid from the outlet line of the wash/motive tank through the eductor to create a vacuum in the return line and draw liquid from the service tank assembly. Means are provided for selectively delivering the motive liquid and returned liquid either back into the wash/motive tank or to a point of drain or other disposal. Valves control the flow of the cleaning solutions from the recirculating lines to the rinse and wash/motive tanks. Heating devices, such as heat exchangers, are provided in the recirculating lines and in the feed lines, for adding heat to the cleaning solution in those lines. A control mechanism is provided for controlling the valves and pumps to permit flow of cleaning solution as necessary to clean the service tank assembly.

The invention also includes a method of cleaning the service tank assemblies, including rinsing water through the washing circuit and service tank assembly, circulating wash solution through the wash/motive tank and water through the rinse tank, thereby washing the equipment that will be washing the service tank assembly, permitting inflow of wash solution into the wash/motive tank and the service tank assembly, circulating the wash solution throughout the service tank assembly, permitting the used wash solution to exit the service tank assembly, rinsing the service tank assembly with pure water, and using compressed air to empty all liquid from the service tank assembly.

Other objects and advantages of the invention will become apparent hereinafter.

DESCRIPTION OF THE PREFERRED EMBODIMENT

Figure 1:
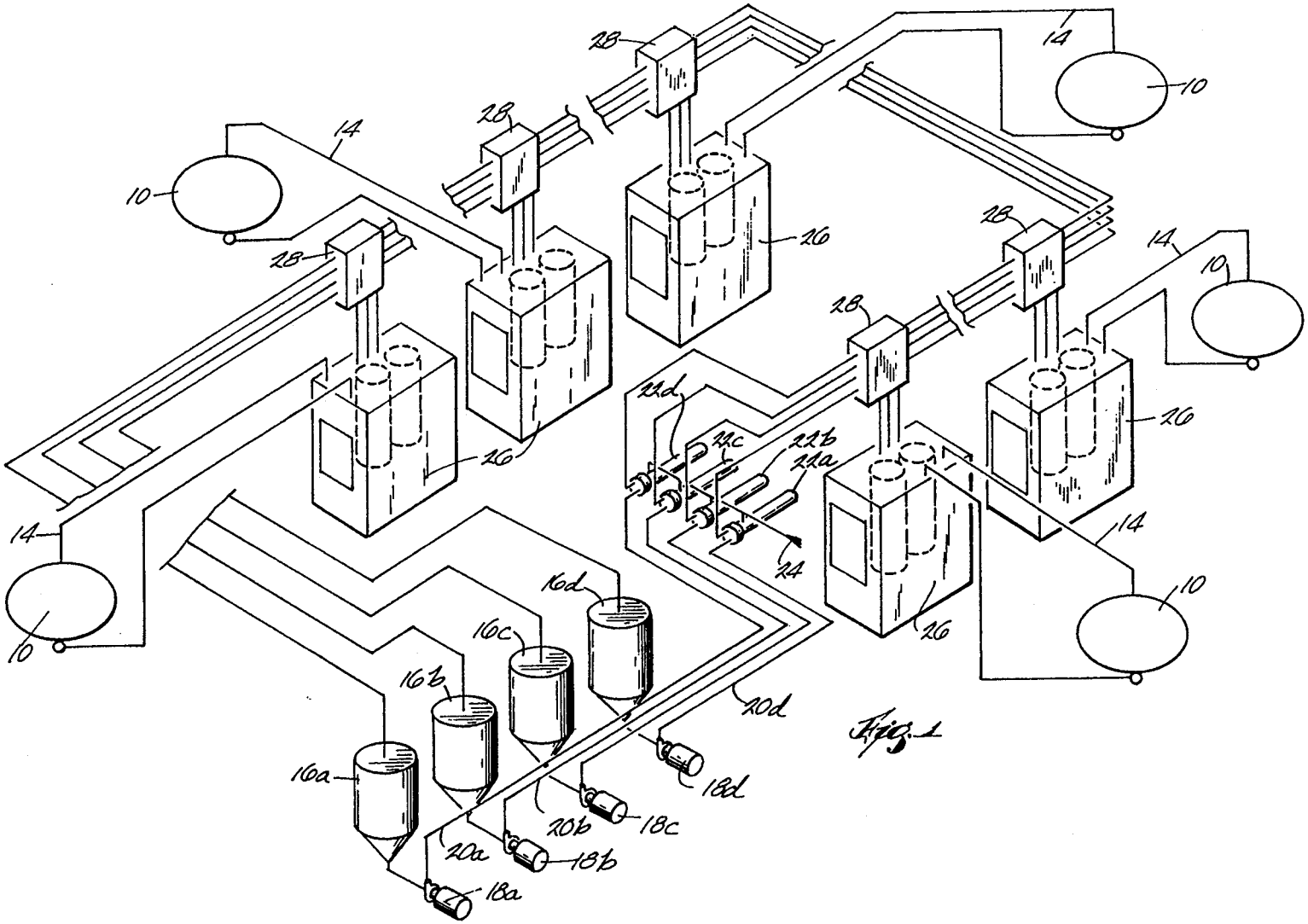
FIG. 1 is an isometric view, partially schematic, of a clean-in-place system constructed according to a preferred embodiment of the invention.

Referring now to the drawing figures, there are shown several service tanks 10. These service tanks could be any mix of two or more of any of stationary milk tanks or pharmaceutical or soft drink distribution tanks, tanks mounted on a transportation vehicles, silo tanks, cooking vats, or any other containers or enclosures requiring clean-in-place container or product-pipeline cleaning action.

The invention provides a clean-in-place system 12 to clean the service tanks 10 and the associated piping, valve and control mechanisms, hereinafter collectively referred to as tank circuits 14. According to the invention, the clean-in-place system 12 includes a set of large storage tanks 16 for storing the various types of cleaning solutions. For instance, depending on the type of materials to be cleaned out of the tanks, there may be acid wash solutions, caustic wash solutions, soft water, water for injection (that is, treated water), pH balance solutions, Cl-caustic wash solutions, and others. Each of these solutions will be stored in a separate storage tank **16*a*, 16*b*, 16*c*, 16*d*, and so on, with the number of storage tanks being supplied according to the cleaning requirements, and the number of different solutions required, in the plant where the cleaning system is installed. It would not be unusual that these storage tanks 16 would be 200 to 250 gallons in size. Generally these storage tanks 16** would be located together in a substantially single site within the plant.

A recirculating pump 18*a*, 18*b*, 18*c*, 18*d*, is supplied for each of the storage tanks 16, for pumping solution from each tank into a respective recirculating line 20*a*, 20*b*, 20*c*, 20*d*. Each respective recirculating line 20 eventually empties into the respective tank 16 from which its solution originated. Heating devices, such as heat exchangers 22*a*, 22*b*, 22*c*, 22*d*, may be supplied in the recirculating lines to add heat, if necessary, to maintain the temperature of the solutions at a predetermined level. Of course a source of steam 24 or other heat energy would be supplied to the heat exchangers 22 to provide the necessary heat.

The recirculating lines 20 carry the necessary cleaning solutions to a number of cleaning stations 26, corresponding in number to the number of service tanks 10 to be cleaned. Each of the cleaning stations 26 is located near to its respective service tank 10, and is provided with a connector/control 28 to the recirculating lines 20. The purpose of connector/control 28 is to permit or prevent flow of the solutions from the recirculating lines 20 into the cleaning station 26. Since each of the cleaning stations 26 is substantially identical to the others, other than perhaps the type of service tank with which it is associated, the detail of the one cleaning station 26 shown in FIG. 2 describes them all.

Each of the cleaning stations 26 includes a pair of tanks, one a wash/motive tank 30 and the other a rinse tank 32. These tanks are preferably formed of stainless steel and may be very similar in size, preferably in the range of forty to fifty gallons. For ease of manufacture, these tanks may be formed by cutting lengths of stainless tubing, for example 24 inches in diameter, and cut to a predetermined length to obtain the desired volume. The ends may then be closed by any suitable means, such as clamping flat plates (not shown), sized to fit, over the open ends in a conventional manner.

Figure 2:
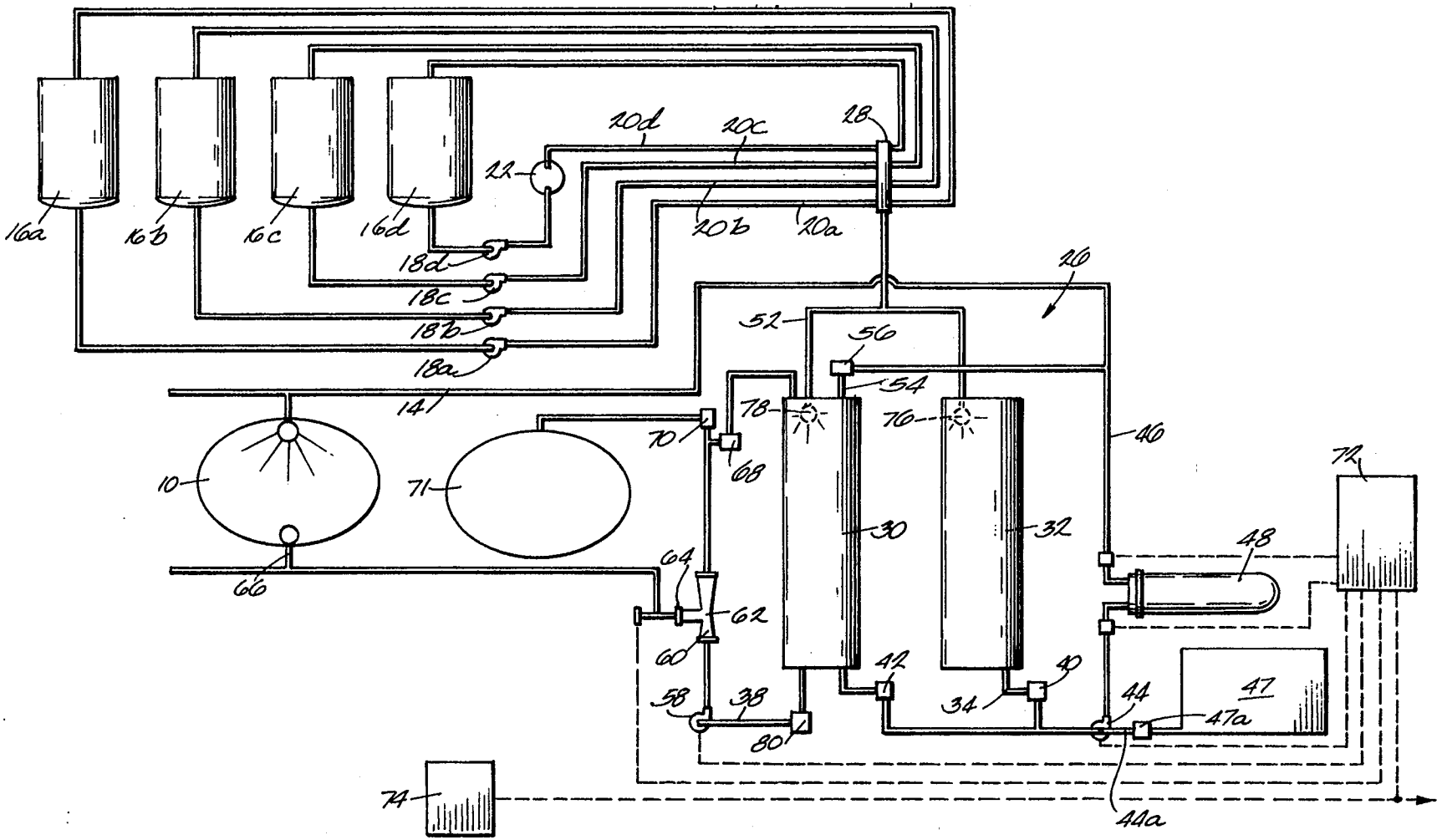
FIG. 2 is a front elevational view, partially schematic, of a cleaning station connected to a recirculating line, constructed according to the same embodiment of the invention as shown in FIG. 1.

In the preferred embodiment shown in FIG. 2, the rinse tank 32 has an outlet 34 at the bottom, and the wash/motive tank 30 has two outlets 36, 38 at its bottom. Rinse tank outlet 34 and one motive tank outlet 36 are separately controlled by valves 40, 42, which control flow of solution from those tanks to a CIP supply pump 44. Supply pump 44 pumps the solution it receives to the service tank 10 via a feed line 46. A supplemental wash tank 47, which contains wash chemical suitable for the intended purpose, may also be provided, connected to the inlet side of supply pump 44. The flow of wash chemical from supplemental tank 47 to supply pump 44 is controlled by supplemental wash valve 47*a*, and permits the addition of a greater concentration of wash chemical if that is desired for a particular application. A heating device, such as a heat exchanger 48, is added in the feed line 46 to add additional heat to the solution on its way to the service tank 10.

Both the rinse tank 32 and the wash/motive tank 30 have inlet lines 50, 52 permitting inflow of solution from the recirculating lines 20. In addition, wash/motive tank 30 has an inlet line 54 from feed line 46, controlled by a valve 56. The second outlet 38 from the wash/motive tank 30 leads to a motive pump 58, which pumps solution from the wash/motive tank 30 to the motive fluid inlet 60 of an eductor 62. Eductor 62 also has a vacuum inlet 64, which is connected to a return line 66 from the service tank 10. The outlet of eductor 62 leads to control valves 68, 70 which can either permit the solution to return to the wash/motive tank 30, or send the solution to drain. If necessary or desirable, instead of letting the solution run to drain, the solution can be piped to a disposal facility 71, such as a pH balance tank, where the solution can be further processed before being sent to drain.

All of the valves and pumps in cleaning station 26 are controlled by a CIP station control 72. In turn, all of the station controls 72 for the various cleaning stations 26 may be linked to a main control 74, permitting easy control from a central location.

In operation, the first procedure is the Soft Water Pre-Rinse. This step will remove any leftover product from the tank circuit 14. Soft water is permitted to enter the circuit 14 from the proper recirculating line 20 while some of it is allowed to go straight to the wash/motive tank 30. Once the level in the wash/motive tank 30 reaches its minimum to operate the motive pump 58, the pump will start recirculating the water through the eductor 62. The vacuum created at the eductor 62 will start to pull the water out of the circuit 14, back to the wash/motive tank 30. As more water comes into the wash/motive tank 30 it will begin to fill towards its maximum level. When the maximum level is achieved, the divert valve 70 will shift so that the returning water goes to the disposal facility 71. The water will be routed to the disposal facility 71 until the level in the wash/motive tank 30 comes down to a preset level, at which time the divert valve 70 will shift to bring the returning water back into the wash/motive tank. The divert valve 70 will shift back and forth controlling the level in the wash/motive tank 30 until the time programmed for the Pre-Rinse has elapsed. After the Pre-Rinse, the water will be shut off and the supply pump 44 stopped. Air will be blown through the circuit 14 to push the water out. Once the water is evacuated from the circuit 14, the divert valve 70 will route the water to the disposal facility 71. No water will return to the wash/motive tank 30. The motive pump 58 will empty out the remaining water from the wash/motive tank 30.

The purpose of the second step, Pre-Wash, is to wash the equipment that will be washing the circuit 14. This will eliminate the possibility of unwanted material to be introduced into the cleaning station 26 during the wash cycle. Pure water from the proper recirculating line 20 will enter the rinse tank 32 through a spray ball 76 thus cleansing the sidewalls. Wash solution from the proper recirculating line 20, through the wash/motive tank 30, will flow into the suction side of the supply pump 44 before going through the heat exchanger 48. As it does so, the solution is routed through a spray ball 78 to clean the wash/motive tank 30. A motive outlet valve 80 will open and allow the solution to be pulled out by the motive pump 58. The divert valve 70 will be sending the solution on to the disposal facility 71 except for some pulses that will clean the valve and its return line to the wash/motive tank 30. The motive tank outlet valve 42 that supplies the supply pump 44 will pulse a few times to clean out that area as well. After all of these components are cleaned, the excess solution will be pumped out to the disposal facility 71.

Now the Wash-Charge step begins. This step will fill the wash/motive tank 30, as well as the circuit 14 to be cleaned, with wash solution. The supply pump 44 may draw pure water from the rinse tank 32, in which case wash chemical is injected into the suction side of the pump from supplemental wash tank 47, creating wash solution inside the pump. The additional wash chemical can be supplied on the basis of time, or on the basis of a desired concentration of wash chemical in the solution, if a suitable sensor is provided. The wash solution thus created inside pump 44 is then routed through the heat exchanger 48 and into the circuit 14, with a portion of the solution being routed to the wash/motive tank 30. This will continue until the minimum operating level is reached. Alternatively, the wash/motive tank 30 may be filled to its minimum operating level with wash solution from one of the large storage tanks 16. Once this minimum level is attained, the motive pump 58 will start. All the returning solution is sent to the wash/motive tank 30 causing it to fill. When it reaches its full level, then the Wash-Charge step is complete.

With the wash/motive tank 30 and circuit 14 filled with wash solution, the Wash step begins. The solution is now drawn from the wash/motive tank 30 by the supply pump 44. Simultaneously the solution is routed through the eductor 62. The wash solution is now being recirculated through the circuit 14 and wash/motive tank 30. The wash chemical may still be added to the solution from supplemental wash tank 47 until it is up to the recommended concentration for that circuit. The cleaning station 26 will continue to run until it has met its time and temperature requirements imposed by the control 72. Throughout this step, some wash solution will be sent to the wash/motive tank 30 through its spray ball 78 to wash it thoroughly.

With the circuit 14 clean, the cleaning station 26 will now dump the used wash solution, in the Wash Dump step. The supply pump 44 pumping solution to the circuit 14 will stop, and an air blow procedure will begin. The motive pump 58 will continue to run, drawing the remaining solution out of the circuit 14. The returning solution is routed by the divert valve 70 to either the wash/motive tank 30 or the disposal facility 71 depending upon the level in the wash/motive tank 30. After the solution is out of the circuit 14, the divert valve 70 will route all flow to the disposal facility 71. This will continue until all the wash solution is removed from the cleaning station 26.

The Pure Rinse step now follows. This step removes all the wash solution residue from the circuit 14. This step operates like the Pre-Rinse step except pure water is used instead of soft water.

The Post-Rinse step begins by using air blow and the eductor 62 to empty out the circuit 14. Once this step is complete, the wash/motive tank 30 is given a thorough rinse with pure water. This step will finish by emptying the rinse tank 32 into the wash/motive tank 30 and then having the motive pump 58 empty out the wash/motive tank into the disposal facility 71. All components are rinsed and the cleaning station 26 is ready to begin another wash operation when needed.

Accordingly the invention provides a system for cleaning a service tank installation with a minimum of floor space, a minimum of investment and a minimum of volume storage of cleaning solutions.

While the apparatus hereinbefore described is effectively adapted to fulfill the aforesaid objects, it is to be understood that the invention is not intended to be limited to the specific preferred embodiment of cleaning system set forth above. Rather, it is to be taken as including all reasonable equivalents to the subject matter of the appended claims.

We claim:

1. A cleaning system for cleaning a plurality of service tanks, located at different sites spaced widely apart from each other, said cleaning system comprising:

a single set of storage tanks, located substantially at one site, for storing various cleaning solutions;

a recirculating line for each of said plurality of storage tanks;

a plurality of cleaning stations, each located relatively close to a respective service tank, each said cleaning station having a connection to each recirculating line, each cleaning station including:

a wash/motive tank for a washing liquid;

an outlet line leading from said wash/motive tank;

a rinse tank for a rinsing liquid;

an outlet line leading from said rinse tank;

a feed line for conveying liquid from both outlet lines to the respective service tank;

a return line adapted to return liquid from the respective service tank;

an eductor having a vacuum opening connected to said return line;

a motive pump four delivering liquid from said outlet line of said wash/motive tank through said eductor to create a vacuum in said return line and draw liquid from the service tank;

valve controls for selectively directing said motive liquid and returned liquid either back into said wash/motive tank or to a recycling facility; and valve controls for controlling the flow of said cleaning solutions from the recirculating lines to the rinse tank and wash/motive tank.

2. A cleaning system as recited in claim 1 further comprising a heating device in at least one of said recirculating lines, for adding heat to the cleaning solution in the line to which the heating device is attached.

3. A cleaning system as recited in claim 1 further comprising a heat exchanger connected in at least one of said recirculating lines, for adding heat to the cleaning solution in the line to which the heat exchanger is attached.

4. A cleaning system as recited in claim 1 further comprising a heating device in said feed line, for adding heat to the cleaning solution on its way to the service tank.

5. A cleaning system as recited in claim 1 further comprising a heat exchanger in said feed line, for adding heat to the cleaning solution on its way to the service tank.

6. A cleaning system as recited in claim 1 further comprising a control device for controlling said valves and pumps to permit flow of cleaning solution as necessary to clean the service tank.

7. A cleaning system as recited in claim 1 further comprising a pump for pumping solution from at least one of said storage tanks into the respective recirculating line, which respective recirculating line eventually empties into the respective storage tank from which its solution originated.

8. A cleaning system as recited in claim 1 further comprising a supply pump in the feed line, for conveying liquid to the respective service tank.

* * * * *